US005445293A

United States Patent [19]

Schutz

[11] Patent Number: 5,445,293

[45] Date of Patent: Aug. 29, 1995

[54] LID SEAL FOR WIDE-MOUTHED BARRELS OF SYNTHETIC RESIN

[76] Inventor: Udo Schutz, Ruckersteg 4, D-5418 Selters, Germany

[21] Appl. No.: 282,459

[22] Filed: Jul. 29, 1994

Related U.S. Application Data

[62] Division of Ser. No. 992,434, Dec. 17, 1992, Pat. No. 5,368,182.

[30] Foreign Application Priority Data

Dec. 23, 1991 [DE] Germany ..... 41 42 737.8

[51] Int. Cl.[6] ..... B65D 45/32

[52] U.S. Cl. ..... 220/319; 220/315; 220/378

[58] Field of Search ..... 220/315, 319, 320, 327, 220/324, 378; 215/274

[56] References Cited

U.S. PATENT DOCUMENTS

| | | | |
|---|---|---|---|
| 2,412,603 | 12/1946 | Dauphinais . | |
| 2,829,793 | 4/1958 | Baumann . | |
| 3,746,206 | 7/1973 | Utz . | |
| 3,924,649 | 2/1975 | Totman . | |
| 3,981,409 | 9/1976 | Flanders . | |
| 4,166,549 | 9/1979 | Schutz et al. | 220/319 |
| 4,177,934 | 12/1979 | Hammes et al. . | |
| 4,347,947 | 9/1982 | Hammes | 220/378 |
| 4,500,010 | 2/1985 | Schütz . | |
| 4,585,138 | 4/1986 | Jonkers . | |
| 4,589,643 | 5/1986 | Breum . | |
| 4,880,138 | 11/1989 | Pfeiffer et al. . | |
| 4,941,588 | 7/1990 | Flider . | |
| 5,102,001 | 4/1992 | Teague et al. . | |
| 5,368,182 | 11/1994 | Schutz | 220/319 |

FOREIGN PATENT DOCUMENTS

| | | | |
|---|---|---|---|
| 2544491 | 12/1983 | Germany . | |
| 115336 | 5/1918 | United Kingdom . | |
| WO93/02938 | 2/1993 | WIPO | 220/319 |

OTHER PUBLICATIONS

NORMA Kegelflanschverbindungen (clamping rings profiled in a U shape).

*Primary Examiner*—Allan N. Shoap
*Assistant Examiner*—Vanessa Caretto
*Attorney, Agent, or Firm*—Young & Thompson

[57] ABSTRACT

The lid seal for wide-mouthed barrels (2) blow-molded of a synthetic resin utilizes a solid sealing ring (9) of plastic, this ring being in contact with the underside of a solid flange (10) projecting radially outwardly at a spacing below the barrel opening from the barrel wall, as well as a counter ring (11), likewise produced of plastic, this counter ring resting on a flange (12) molded on the bottom to the outer lid rim (4). Locking sleeves (13, 14) are formed on the clamping rings (9, 11), distributed about the circumference, these sleeves engaging in corresponding bores (15, 16) in the barrel flange (10) and in the lid flange (12). The clamping rings (9, 11) and the locking sleeves (13, 14) molded thereon have conical aligned through bores (17, 18). For closing the lid (1) placed on the wide-mouthed barrel (2), clamping bolts (19) of plastic or metal are pressed, by a pressing tool, from above into the conical bores (18, 17) of the two clamping rings (11, 9). The ring (9) in contact with the barrel border (10) is supported by a corresponding device. On account of the clamping force exerted by the clamping bolts (19), the lid gasket (8) is pressed against the opening rim of the barrel neck (3).

4 Claims, 4 Drawing Sheets

LID SEAL FOR WIDE-MOUTHED BARRELS OF SYNTHETIC RESIN

Figure 1:
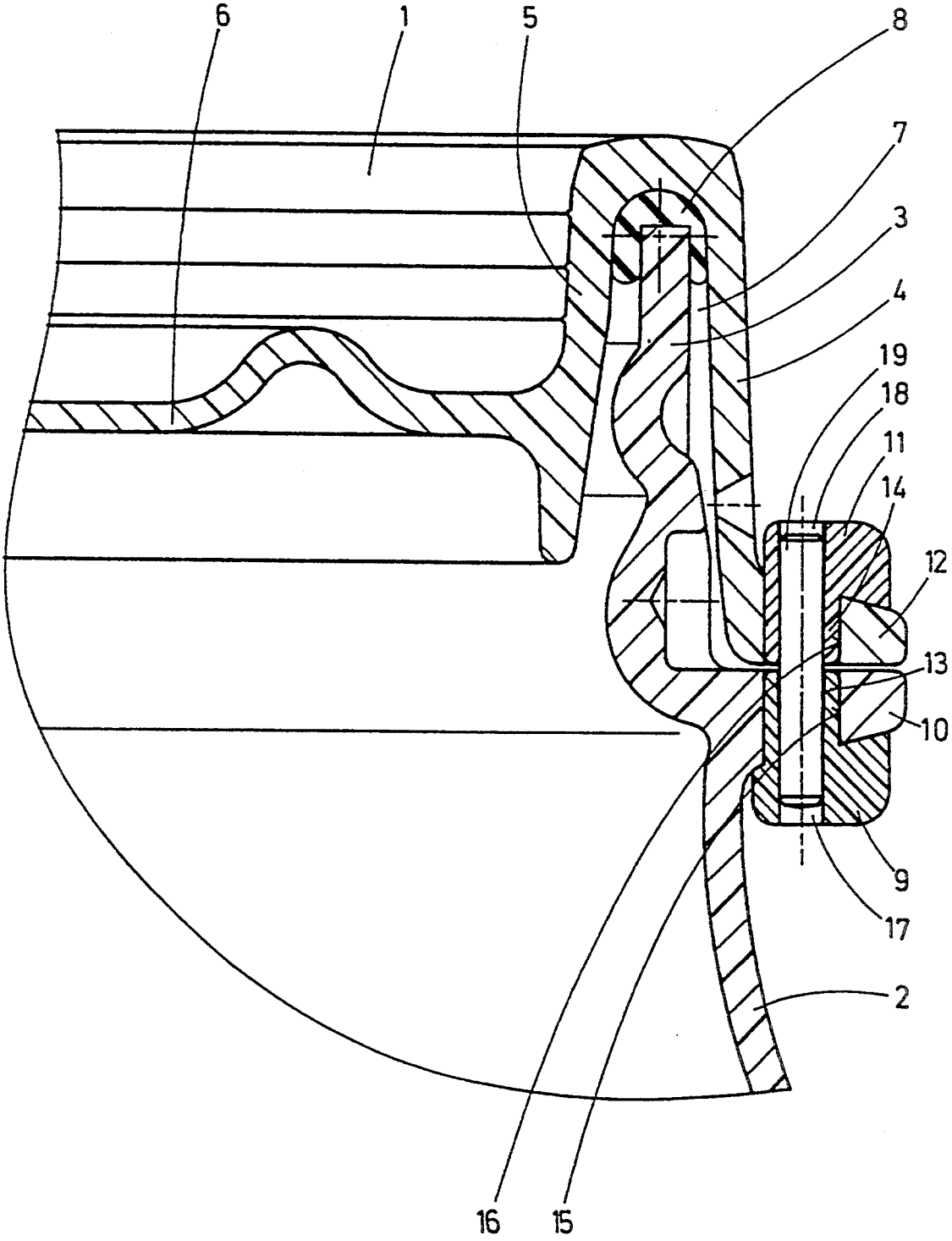

This application is a division of application Ser. No. 07/992,434, filed Dec. 17, 1992, now U.S. Pat. No. 5,368,182.

The invention relates to a lid seal for wide-mouthed barrels of synthetic resin, having an outer rim encompassing the neck of the blow-molded plastic barrel and with an inner rim dipping into the barrel neck and projecting beyond the lid bottom below the barrel opening, and having a gasket inserted or foamed into the annular space between the outer lid rim and the inner lid rim, this gasket being urged by a seal against the opening rim of the barrel neck, the seal clamping in place a flange or, respectively, flange sections, molded at the bottom to the outer lid rim, against a solid border radially outwardly projecting from the barrel wall at a spacing below the barrel opening.

In such a wide-mouthed barrel, known from DE 25 44 491 C2, the lid is sealed by means of a metal clamping ring exhibiting a trapezoidal profile, this ring being placed around the lid flange and the barrel border. This lid closure harbors the danger that upon impact of the lid rim on the ground during a fall of the barrel from a height, or during the tilting over of the barrel, the clamping ring is deformed and the lid loses its sealing.

The invention is based on the object of developing a barrel lid seal improved with respect to its functional safety.

The lid seal according to this invention is distinguished by the following advantages:

The two clamping rings of the lid seal are elastically deformable so that, upon exposure to external force by impact or shock upon falling or tipping over of the barrel, the danger of damage to the seal and thus an ensuing leakage of the barrel lid is prevented. The lid seal can be mounted on the barrel lid quickly and simply with an appropriate device. On account of the two clamping rings, the barrel flange and the lid flange are reinforced so that the stacking load on a barrel equipped with the novel seal can be increased. By providing a plastic barrel with the lid seal of plastic, the barrel can be readily subjected to a recycling process on account of the use of a single manufacturing material. Finally, the lid of a barrel prepared for the novel sealing system can, if needed, be closed off by a conventional clamping ring.

Figure 2:
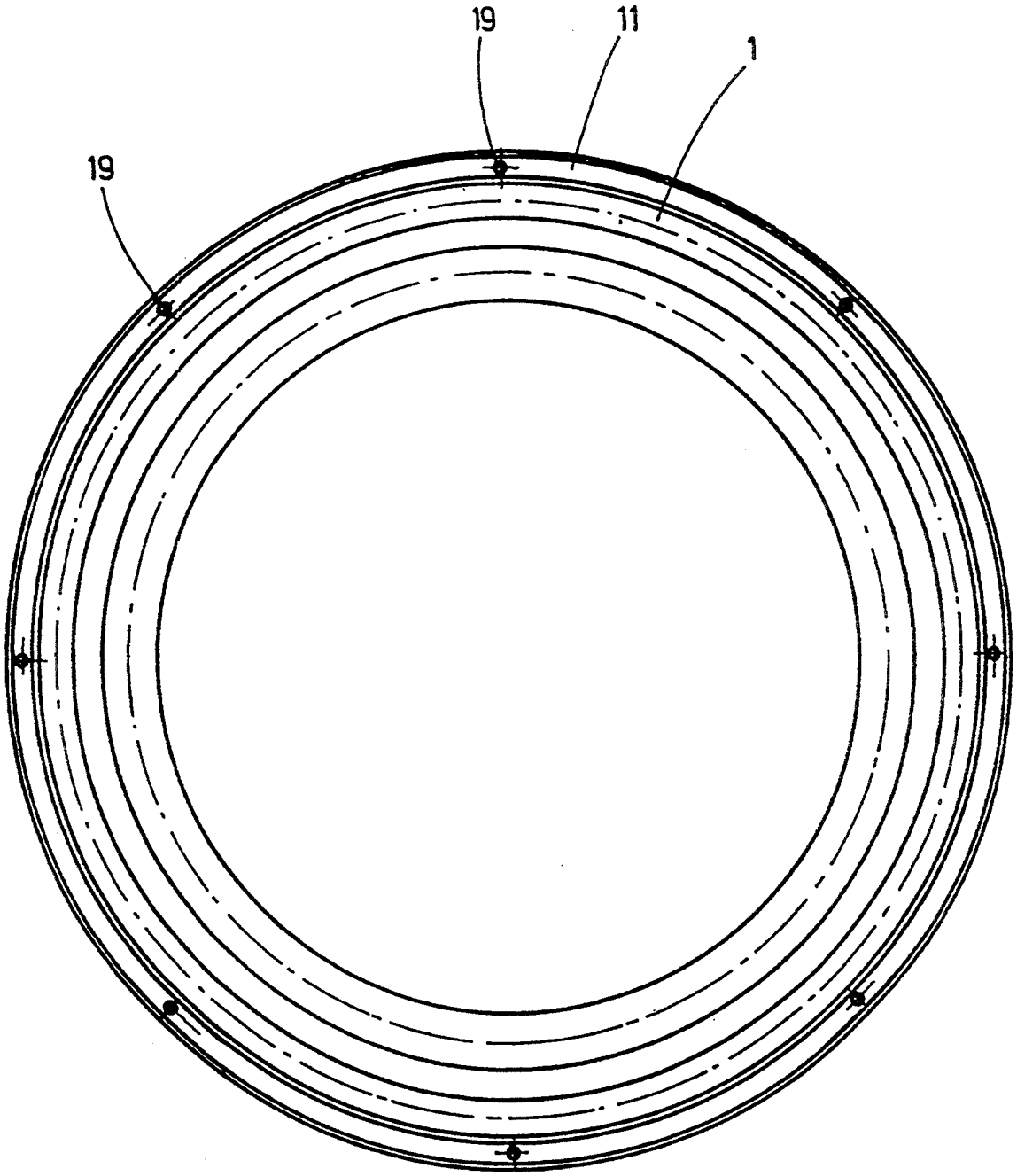
Figure 3:
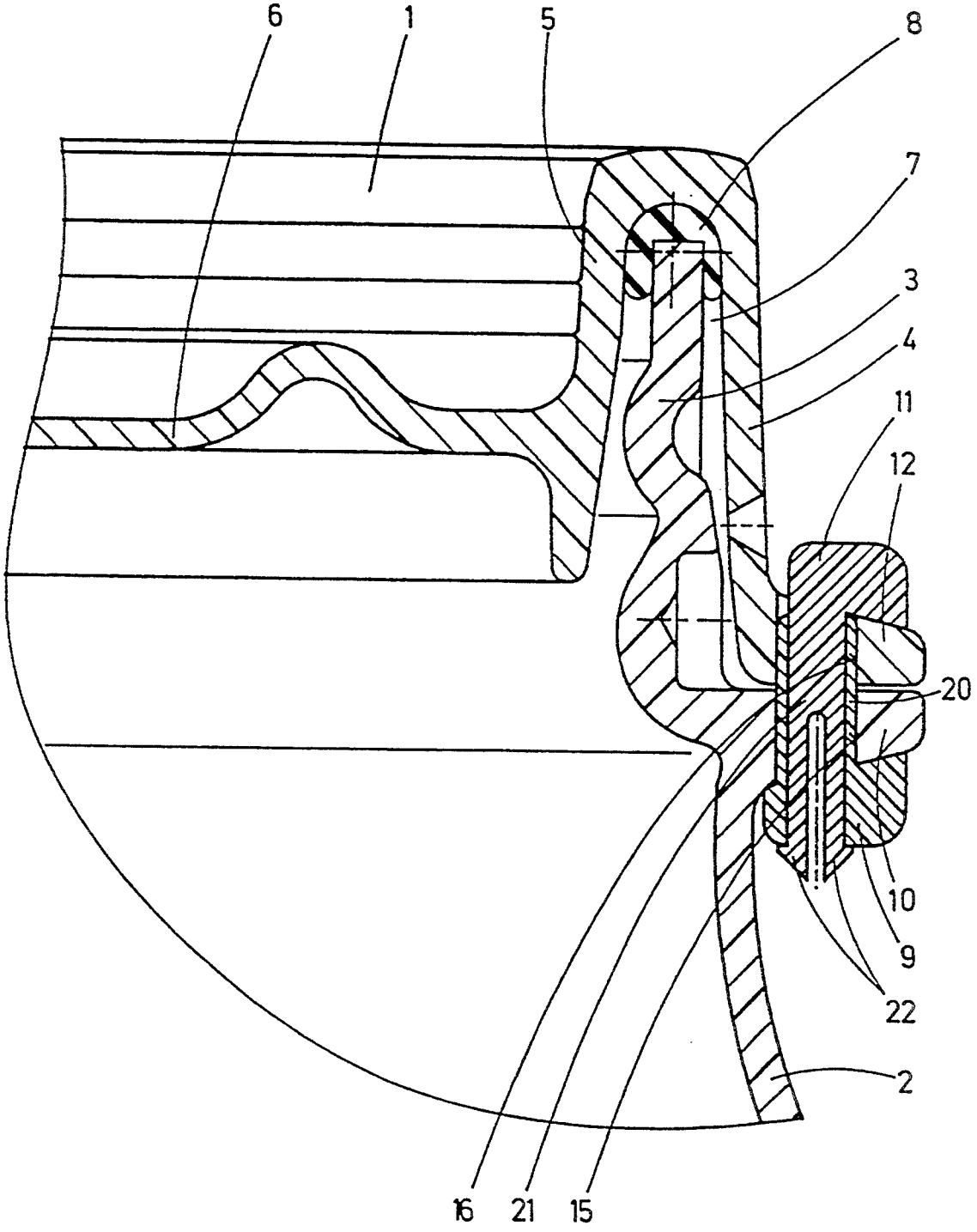
Figure 4:
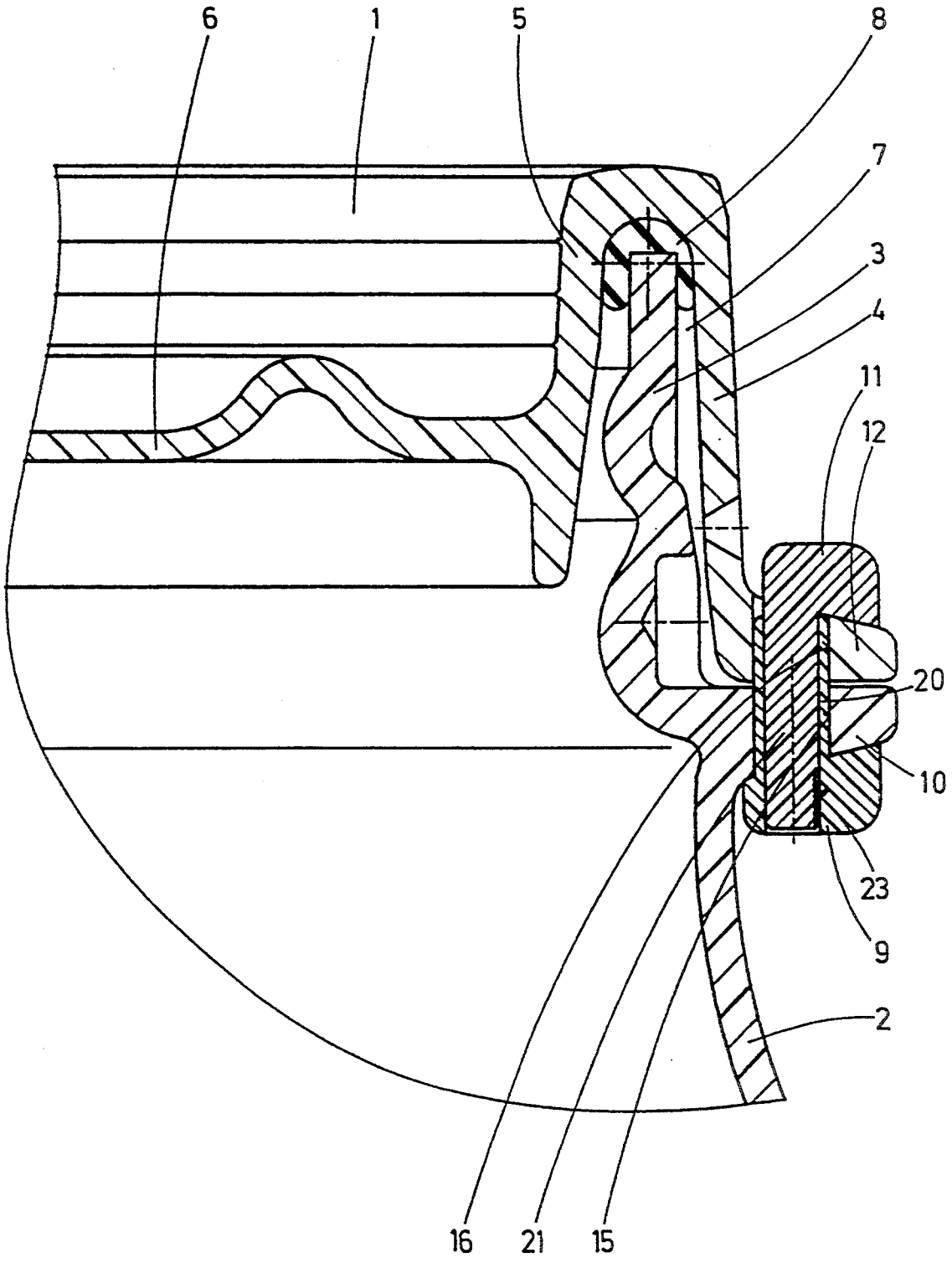

The invention is described in greater detail below with reference to various embodiments of lid seals for wide-mouthed barrels illustrated in the drawings wherein:

FIG. 1 shows a fragmentary enlarged sectional view of a wide-mouthed barrel lid provided with a first embodiment of the novel seal, FIG. 2 is a top view of the complete lid according to FIG. 1, and FIGS. 3 and 4 show illustrations of wide-mouthed barrel lids corresponding to FIG. 1, with two further embodiments of the lid seal.

The lid 1, injection-molded, for example, of polyethylene, which can be attached by means of the various seals illustrated in FIGS. 1 through 4 to a wide-mouthed barrel 2 blow-molded from a synthetic resin, comprises an outer rim 4 encompassing the barrel neck 3 and an inner rim 5 dipping into the barrel neck 3, projecting beyond the lid bottom 6 below the barrel opening. A gasket 8 is inserted or foamed in place in the annular space 7 between the outer lid rim 4 and the inner lid rim 5.

The lid seal according to FIGS. 1 and 2 utilizes a solid clamping ring 9 of plastic, this ring being in contact with the underside of a solid flange 10 which latter projects radially outwardly at a spacing below the barrel opening, away from the barrel wall. The arrangement further includes a counter ring 11, likewise made of a synthetic resin, resting on a flange 12 molded at the bottom to the outer lid rim 4. Locking sleeves 13, 14 are molded on the clamping rings 9, 11, distributed about the circumference thereof, and engage in corresponding bores 15, 16 in the barrel flange 10 and in the lid flange 12. The clamping rings 9, 11 and the locking sleeves 13, 14 molded thereon have conical through bores 17, 18. For closing the lid 1, placed on the wide-mouthed barrel 2, clamping bolts 19 of plastic or metal are urged from above by means of a pressing tool into the conical bores 18, 17, aligned with each other, of the two clamping rings 11, 9; and during this operation the ring 9, in contact with the barrel flange 10, is supported by means of an appropriate device. On account of the clamping force exerted by the clamping bolts 19, the gasket 8 is pressed against the opening rim of the barrel neck 3.

In the lid closure according to FIG. 3, locking sleeves 20 are molded on the clamping ring 9, in contact with the barrel flange 10, these sleeves being distributed about the ring circumference and engaging in corresponding bores 15, 16 in the barrel flange 10 and in the lid flange 12, aligned with respect to each other in congruent fashion. The counter ring 11, placed from above onto the lid flange 12, has clamping bolts 21 formed integrally with this ring, which are inserted into the locking sleeves 20 of the ring 9; these bolts are split and snap behind the ring 9 with barbs 22 formed at the resilient ends provided by their split construction.

The lid seal according to FIG. 4 differs from the seal of FIG. 3 by the feature that the clamping bolts 21 formed on the counter ring 11 are locked together with the clamping ring 9 by means of claw elements 23 arranged at the ends, so that opening of the lid closure is possible only by destruction of the clamping rings 9, 11, and this seal thus constitutes a security seal for the barrel.

The clamping rings 9, 11 are produced as plastic injection-molded parts.

What is claimed is:

1. A sealing lid and wide-mouthed barrel of synthetic resin, said lid having a central panel surrounded by an outer rim encompassing a neck of said blow-molded plastic barrel and an inner rim dipping into the barrel neck and projecting beyond said panel below the barrel opening, as well as a gasket extending into an annular space between the outer lid rim and the inner lid rim, said gasket being clamped against an opening rim of the barrel neck by clamping together a molded flange on a lower end of the outer lid rim, against a flange radially outwardly projecting from the barrel side wall at a spacing below the barrel opening; the improvement comprising a clamping ring (9) in contact with the underside of the barrel flange (10), a counter ring (11) resting on the lid flange (12), and clamping elements penetrating bores (15, 16) in the barrel flange (10) and in the lid flange (12) and clamping the clamping ring and the counter ring (9, 11) together, said clamping elements comprising locking sleeves (20) molded on the clamping ring (9) in contact with the barrel flange (10)

and distributed about the clamping ring circumference, said sleeves engaging in corresponding aligned bores (15, 16) in the barrel flange (10) and in the lid flange (12), and clamping bolts (21) formed on the counter ring (11) resting on the lid flange (12), said bolts being disposed in the locking sleeves (20) and being locked in shape-mating fashion together with the clamping ring (9) that contacts the barrel flange (10).

2. A sealing lid and barrel according to claim 1, there being barbs (22) on resilient ends of the clamping bolts (21), these barbs snapping behind the clamping ring (9) that contacts the barrel flange (10).

3. A sealing lid and barrel according to claim 1, there being claw elements (23) at distal ends of the clamping bolts (21) and locked together with the clamping ring (9) that contacts the barrel flange (10).

4. A sealing lid and barrel according to claim 1, wherein the clamping ring and the counter ring (9, 11) are plastic injection-molded parts.

* * * * *